US006621201B2

(12) United States Patent
Jeon et al.

(10) Patent No.: US 6,621,201 B2
(45) Date of Patent: Sep. 16, 2003

(54) FLAT MASK FOR CATHODE RAY TUBE

(75) Inventors: Sang-Ho Jeon, Seongnam (KR); Jong-Han Rhee, Suwon (KR); Hyang-Jin Koh, Suwon (KR); Jun-Jong Lee, Seoul (KR); Dong-Hwan Kim, Suwon (KR)

(73) Assignee: SamSung SDI Co., Ltd., Suwon (KR)

( * ) Notice: Subject to any disclaimer, the term of this patent is extended or adjusted under 35 U.S.C. 154(b) by 0 days.

(21) Appl. No.: 10/127,727

(22) Filed: Apr. 23, 2002

(65) Prior Publication Data

US 2002/0190629 A1 Dec. 19, 2002

(30) Foreign Application Priority Data

May 8, 2001 (KR) ..... 2001-0024972

(51) Int. Cl.[7] ..... H01J 29/80
(52) U.S. Cl. ..... 313/402; 313/407; 313/403
(58) Field of Search ..... 313/402–408

(56) References Cited

U.S. PATENT DOCUMENTS 4,162,421 A * 7/1979 Morrell ..... 313/403
4,631,440 A * 12/1986 Robbins ..... 313/403
6,208,067 B1 * 3/2001 Nakagawa et al. ..... 313/461
6,307,311 B1 * 10/2001 Ito et al. ..... 313/407
6,407,490 B1 * 6/2002 Shin et al. ..... 313/403

FOREIGN PATENT DOCUMENTS

JP 55126945 * 10/1980 ..... H01J/29/07

* cited by examiner

*Primary Examiner*—Vip Patel
*Assistant Examiner*—Anthony Perry
(74) *Attorney, Agent, or Firm*—Robert E. Bushnell, Esq.

(57) ABSTRACT

The present invention describes the details of a flat mask before tension is applied, an assembling method of that flat mask, and a tension mask assembly manufactured by using that method in order to obtain satisfactory thermal expansion, uniform stress distribution and linearity. The flat mask includes an apertured portion and supporting ends surrounding the apertured portion. The apertured portion comprises a plurality of concave pin-cushion type or convex barrel type strips, a plurality of real bridges connecting strips and dividing slots, and dummy bridges formed in the slots. The short supporting ends have the same width along a longitudinal direction and are formed to have the same curvature as the strips facing the supporting ends. The short supporting ends are preferably half-etched in order to make the volume of material removed from the short supporting ends greater than the volume of material removed from the apertured portion. Therefore, the short supporting ends can have grooves on their front and rear sides. In addition, the corner portions of the supporting ends are made to have sloping sides at a predetermined angle. As a result of manufacturing the tension mask by using the method of the present invention, the apertured portions of the tension mask have satisfactory thermal expansion, uniform stress distribution and linearity. In addition, it is possible for the tension mask to be prevented from having deformation caused by heat treatment after being held under tension.

20 Claims, 4 Drawing Sheets

(A)

(B)

FLAT MASK FOR CATHODE RAY TUBE

CLAIM OF PRIORITY

This application makes reference to, incorporates the same herein, and claims all benefits accruing under 35 U.S.C. §119 from my application FLAT MASK AND METHOD FOR ASSEMBLING THEREOF, AND TENSION MASK ASSEMBLY MADE IN ACCORDANCE WITH THIS METHOD filed with the Korean Industrial Property Office on May 8, 2001 and there duly assigned Ser. No.0024972/2001.

BACKGROUND OF THE INVENTION

1. Technical Field

The present invention relates to a flat mask for a cathode ray tube, an assembling method for assembling the flat mask, and a tension mask assembly manufactured by using the method.

2. Related Art

In general, a color cathode ray tube (CRT) for television and computer displays is a device for displaying images by guiding electrons emitted from an electron gun to strike and illuminate particular phosphor areas on an inner surface of the cathode ray tube. The cathode ray tube employs three electron beams, one for each of the primary color components (red, blue and green) of the color video signal, and employs a screen made up of an array of phosphor elements in the three primary colors. A shadow mask is interposed between the electron gun and the screen to permit each electron beam to strike only phosphor elements associated with the particular electron beam.

The shadow mask is usually contoured to be somewhat parallel to the inner surface of the cathode ray tube faceplate, and to be bowed outwardly for a path of the electron beams deflected by a deflection yoke.

Some electrons do not pass through the apertures of the shadow mask. Instead of passing through the apertures, these electrons hit the shadow mask, thereby heating the shadow mask locally. This localized heating causes a transient localized expansion of the mask known as "doming phenomenon". This doming can cause mislanding of the electron beams, which degrades the color purity of the display.

Therefore, shadow masks that are fixed on their frame with a predetermined tension, called a tension mask, have been developed to overcome the above-noted drawbacks and to meet the current trend of making displays large and flat.

Exemplars of efforts in the art include U.S. Pat. No. 4,942,332 for TIED SLIT MASK FOR COLOR CATHODE RAY TUBES issued to Adler et al. on Jul. 17, 1990, U.S. Pat. No. 3,638,063 for GRID STRUCTURE FOR COLOR PICTURE TUBES issued to Tachikawa et al. on Jan. 25, 1972, and Japanese Patent. No. P2000-133161 for COLOR CATHODERAY TUBE with publication date May 17, 2000 and listing inventors Minami Go, Kashihara Shiro, and Oshima Shigenari.

Tachikawa '063 describes a tension mask using an aperture grill. In Tachikawa '063, a plurality of parallel strips is stretched on a pair of opposed supporting members of a mask frame under predetermined tension. In this structure, when the shadow mask is heated by irradiation of electron beams during operation of the color cathode ray tube, the restoring force of the prestressed frame compensates elongation of the strips due to thermal expansion of that portion.

Therefore, it is possible to avoid doming. However, in Tachikawa '063, the strips of the tension mask are fabricated from a thin steel of about 0.1 millimeters (mm) in thickness and are stretched between a pair of supports without being connected to each other, and therefore they vibrate independently due to even a slight impact, which causes the tension mask to resonate. This phenomenon is referred to as howling.

Adler '332 describes a slot-type tension mask to prevent the above-described problems. The slot-type tension mask for a color cathode ray tube comprises a series of parallel strips being disposed at a predetermined pitch and pattern, the strips being loosely coupled by widely spaced real bridges under tension. The strips are connected by real bridges, which are arranged so that the slots form a brick wall-like pattern. In addition, all strips terminate at the top and bottom in end members, which are welded to supporting members of the mask frame. Many slots are formed to pass electron beams emitted from an electron gun. In the tension mask of Adler '332, the strips are connected by real bridges, thereby reducing howling somewhat. However, since the strength of the supporting ends located at edges of the tension mask is greater than that of the apertured portion, the stress is concentrated on the supporting ends so that the portions near the edges of the apertured portion are liable to vibrate.

The Japanese Patent No. P2000-133161 describes a tension mask to solve the above-described problems. In this structure, the tension mask comprises an apertured portion with a plurality of small slots and supporting ends located at edges of the apertured portion, which are fixed on the supporting members of the mask frame with a predetermined tension. A width of short supporting ends becomes wider from a center portion to each corner portion. Before applying tension to the flat mask, if the width of the center portion and the corner portion thereof are assumed to be "a" and "b", respectively, the values are satisfied by the inequality $2 \leqq b/a \leqq 6$. With regard to the flat mask, one side of the short supporting ends is half-etched and then the stress concentrated thereon is decreased, thereby increasing the tension acting on portions near the edges of the apertured portion when tension is applied. As to a tension mask assembly manufactured from the flat mask, the tension acting on portions near the edges of the apertured portion can be the same as that of the central apertured portion by making the width of the each corner portion of the short supporting ends greater than that of central portion thereof by a predetermined ratio, and by half-etching one side of the short supporting ends.

In the Japanese Patent No. P2000-133161, there is a limitation that the width of the corner portions of the short supporting ends should be twice more than that of the central portion thereof to prevent tension acting on portions near the edges of the apertured portion from being less than that of the central apertured portion. In addition, according to Japanese Patent No. P2000-133161, before applying tension, the apertured portion of the mask is formed to have a rectangular shape. As a result, since the mask is expanded longitudinally while being compressed transversely when the shadow mask is applied under tension, slots at portions near the edges of the apertured portion are displaced.

Therefore, the Japanese Patent No. P2000-133161 does not solve all problems, because apertured portions of the tension mask do not maintain a rectangular shape. In addition, since one side of the short supporting ends is half-etched, the mask is liable to bend toward half-etched portions after being held under tension.

While these recent efforts provide advantages, I note that they fail to adequately provide an efficiently and conveniently improved flat mask for cathode ray tube, and assembling method thereof.

SUMMARY OF THE INVENTION

It is therefore an object of the present invention to provide a flat mask of which an apertured portion has satisfactory thermal expansion, uniform stress distribution and linearity, and the width of curved short supporting ends is formed to be the same in the longitudinal direction. The present invention also provides the flat mask, which is manufactured to prevent deformation caused by heat treatment after being held under tension.

Another object of this invention is to provide a method of assembling the flat mask with a mask frame, and a tension mask assembly assembled by using the above method.

In accomplishing these and other objects, according to a first aspect of the present invention, there is provided a flat mask comprising an apertured portion including a plurality of slots formed for passing electron beams and being separated at a predetermined interval, and a plurality of pin-cushion type or barrel type strips. The flat mask also comprises supporting ends including short supporting ends and long supporting ends facing edges of the apertured portion.

The width of the short supporting ends is formed to be the same in a longitudinal direction, and the short supporting ends are curved to have the same curvature as lateral edges of the apertured portion.

The width of the short supporting ends is w1, a half width of the apertured portion is w4, a distance between an end point of an inner boundary of the short supporting ends and a tangent line contacting a central point thereof is w3, an inequality $0.02w4 \leqq w1 \leqq 0.05w4$ between the apertured portion and the short supporting ends, and an inequality $0\ \text{mm} < \pm w3 \leqq 3.0\ \text{mm}$ are satisfied. The w3 is represented as "+w3" in the concave pin-cushion type for FIG. 3 and "−w3" in the convex barrel type for FIG. 4.

In the apertured portion of the flat mask, it is preferable that the strips are connected by a plurality of real bridges forming the slots. In addition, the slots preferably include dummy bridges. A ratio of a longitudinal pitch Pv to a transverse pitch Ph of the real bridge preferably satisfies an inequality $5.0 \leqq Pv/Ph \leqq 12.0$. The apertured portion and the supporting ends of the flat mask are preferably made of iron (Fe).

It is desirable that the longitudinal pitch of the real bridge Pv satisfies the inequality $2.0\ \text{mm} \leqq Pv \leqq 10.0\ \text{mm}$, and removed volumes of the short supporting ends are preferably equal to or larger than removed volumes of the apertured portion by half etching the front and the rear side of the short supporting ends.

In the flat mask, a sloping side is preferably formed near the corner of the supporting ends and a tilt angle θ of the sloping side relative to the longitudinal direction of the short supporting ends satisfies the inequality $0° < \theta < 60°$.

According to a second aspect of the present invention, there is provided a plurality of grooves 16 on a front and a rear side of the short supporting ends formed by half-etching. In addition, it is preferable that the grooves 16 are formed along the longitudinal direction, having the same curvature as the short supporting ends 14*b*.

In addition, it is desirable that the grooves 16 are formed at the same transverse pitch as a transverse pitch of the slots formed in the apertured portion, and that the transverse pitch of the grooves 16 is less than 10% of the width of the short supporting ends when the width of the short supporting ends is less than 10 mm. The depth of the grooves is preferably 30–70% of a thickness of the supporting ends, and that the width of the grooves is 30–70% of the transverse pitch of the grooves.

Preferably, positions of the grooves on the front sides of the short supporting ends are different from those on the rear sides of them. Alternately, the grooves on the front sides of the short supporting ends can be opposite to those on the rear sides of them.

An assembling method of the flat mask comprises the steps of longitudinally applying tension to the flat mask in which the tension applied to portions near the edges of the flat mask is greater than the tension applied to a central portion of the flat mask, attaching the long supporting ends of the flat mask to supporting members of a mask frame by welding, and cutting off protruding portions extending from the mask frame of the long supporting ends.

A tension mask assembly is preferably manufactured by using the assembling method of the flat mask.

To achieve these and other objects in accordance with the principles of the present invention, as embodied and broadly described, the present invention provides a mask, comprising: an apertured portion having curved sides and having a plurality of slots and strips, the slots being separated from each other by a predetermined interval, said apertured portion having a shape selected from among a pin-cushion shape and a barrel shape, the strips being shaped to form a pattern corresponding to the shape of said apertured portion, electron beams passing through the slots; and a plurality of supporting ends including two short supporting ends and two long supporting ends, the short supporting ends and the long supporting ends being located at respective edges of said apertured portion, the short supporting ends including a first short supporting end having an inner boundary located at one of the curved sides of said apertured portion and having an outer edge spaced apart from said apertured portion, the inner boundary being curved and extending from a first end point through a center point and to second end point, the first short supporting end having a width extending in a transverse direction from the inner boundary to the outer edge, the short supporting ends being curved to have substantially the same curvature as the curved sides of said apertured portion, said apertured portion having a width extending in the transverse direction; the width of the first short supporting end being w1 as measured from the center point of the inner boundary to the outer edge, half the width of said apertured portion being w4 as measured from center of said apertured portion to the center point of the inner boundary of the first short supporting end, the distance between the first end point and a tangent line extending from the center point of the inner boundary being w3 as measured in the transverse direction; the width w1 being less than or equal to 0.05w4, the width w1 being greater than or equal to 0.02w4, the absolute value of the distance w3 being greater than 0 millimeters, the absolute value of the distance w3 being less than 3.0 millimeters.

To achieve these and other objects in accordance with the principles of the present invention, as embodied and broadly described, the present invention provides a flat mask for a cathode ray tube, comprising: a central part having curved sides and having a plurality of slots and strips, the slots being separated from each other by a predetermined interval, the strips being shaped to form a pattern corresponding to the shape of said central part, electron beams passing through the slots; and a plurality of supporting ends including two short supporting ends and two long supporting ends, the short supporting ends and the long supporting ends being located at respective edges of said central part, the short supporting ends including a first short supporting end having an inner boundary located at one of the curved sides of said central part and having an outer edge spaced apart from said central part, the inner boundary being curved and extending from a first end point through a center point and to second end point, the first short supporting end having a width extending in a transverse direction from the inner boundary to the outer edge, the short supporting ends being curved to have substantially the same curvature as the curved sides of said central part, said central part having a width extending in the transverse direction; the width of the first short supporting end being w1 as measured from the center point of the inner boundary to the outer edge, half the width of said central part being w4 as measured from center of said central part to the center point of the inner boundary of the first short supporting end, the distance between the first end point and a tangent line extending from the center point of the inner boundary being w3 as measured in the transverse direction; the width w1 being less than 0.05w4 and greater than 0.02w4, the absolute value of the distance w3 being greater than 0 millimeters and less than 3.0 millimeters.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENTS

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being abroad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 1:
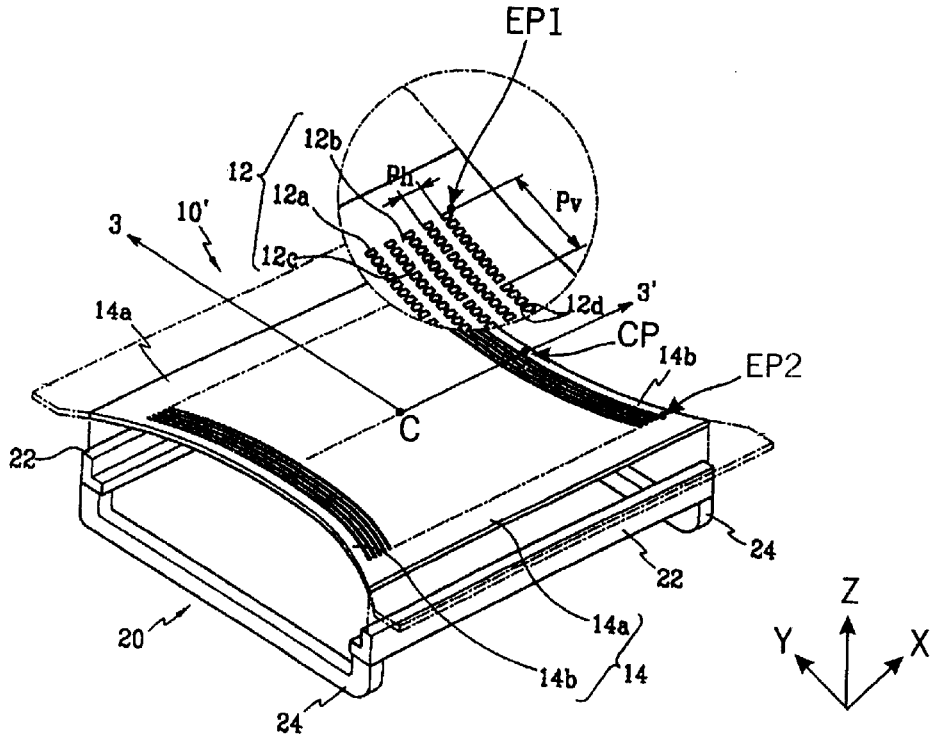
FIG. 1 is an exploded perspective view of a tension mask assembly including a flat mask, in accordance with the principles of the present invention.
Figure 2:
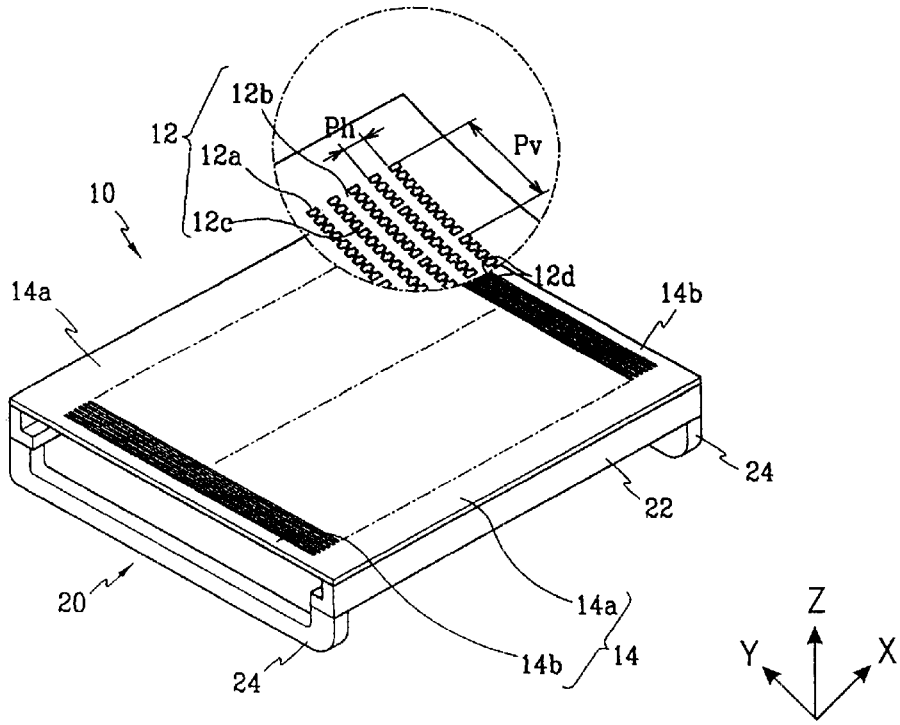
FIG. 2 is an assembled perspective view of the tension mask assembly, in accordance with the principles of the present invention.
Figure 3:
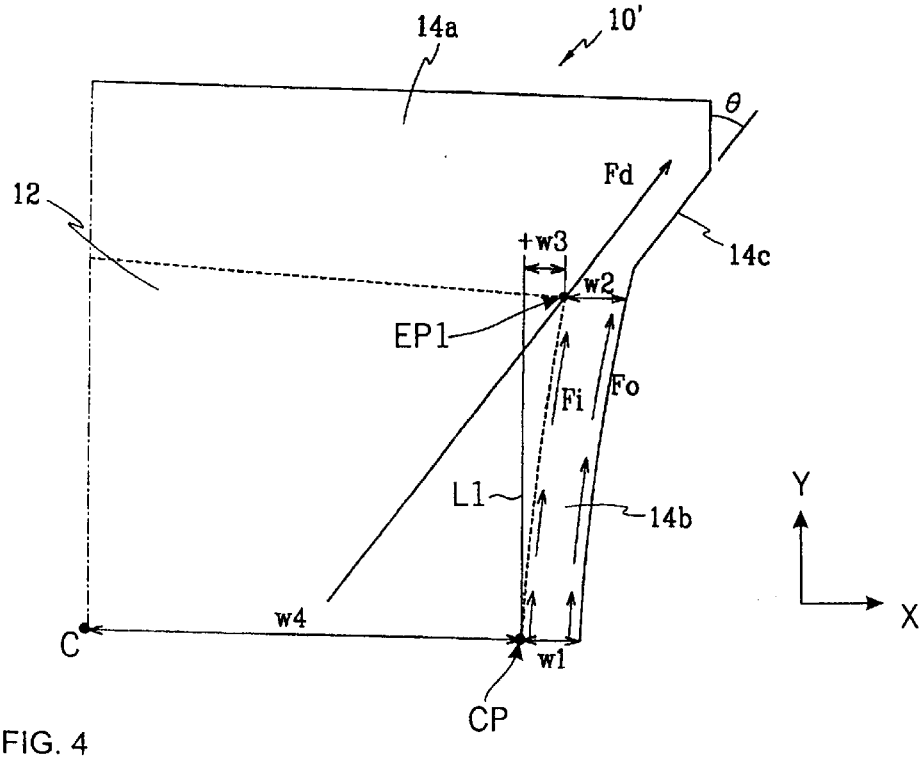
FIG. 3 is a partial plan view of the flat mask of a pin-cushion type divided along the line 3–3' of FIG. 1, in accordance with the principles of the present invention.
Figure 4:
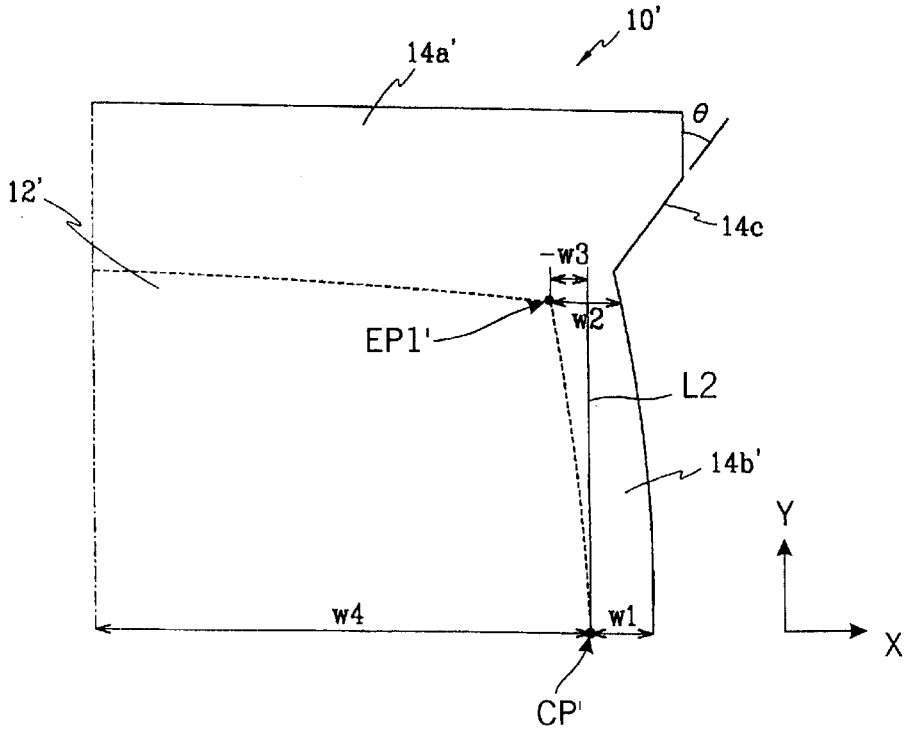
FIG. 4 is a partial plan view of the flat mask of a barrel type, in accordance with the principles of the present invention.

FIG. 1 shows an exploded perspective view of a tension mask assembly including a flat mask, in accordance with the principles of the present invention. FIG. 2 shows an assembled perspective view of the tension mask assembly, in accordance with the principles of the present invention. FIG. 3 is a partial plan view of the flat mask of a pin-cushion type divided along the line 3–3' of FIG. 1, in accordance with the principles of the present invention. FIG. 4 is a partial plan view of the flat mask of a barrel type, in accordance with the principles of the present invention.

In the preferred embodiments, a transverse direction means a direction parallel to the long sides of a flat mask (parallel to the X axis as shown in FIG. 1) and a longitudinal direction means a direction parallel to short sides of a flat mask (parallel to the Y axis as shown in FIG. 1) among the directions explained hereinafter.

FIG. 3 shows a partial plan view of the flat mask divided along the line 3–3' of FIG. 1 to represent a main structure according to the present invention. A mask before applying tension is referred to as a flat mask 10' and a mask assembled under tension in a mask assembly is referred to as a tension mask 10, hereinafter.

As shown in FIGS. 1 and 2, the mask assembly includes a tension mask 10 derived from a flat mask 10' and operating for selecting electron beams, a mask frame 20 supporting the tension mask 10 and a plurality of spring assemblies (not shown) fixing the mask frame 20 in a panel. The mask frame 20 includes a pair of U-shaped elastic members 24 that are parallel to each other and a pair of supporting members 22 supporting long sides of the tension mask 10. The linking ends of the U-shaped elastic members 24 are fixed at a predetermined interval, and the pair of supporting members 22 can be formed to be linear or curved at a predetermined curvature depending on the curvature of the panel.

The flat mask 10' is manufactured by etching a thin plate made of iron (Fe) in a predetermined pattern, and it must be attached to a mask frame 20 in order to maintain the tension on itself. An apertured portion 12 is formed at the central part of the flat mask 10' and passes electron beams emitted from an electron gun. The apertured portion 12 has slots 12*a*, and electron beams can pass through the slots 12*a*. The apertured portion 12 has been given that name because it has apertures formed therein. The apertured portion 12 can also be described as a central part 12 of the flat mask 10'. Supporting ends 14 are located at side edges of the central part 12. The apertured portion 12 includes a plurality of strips 12*b* separated from each other by a predetermined interval to form slots 12*a*, a plurality of real bridges 12*c* linking the strips 12*b* together, with a plurality of dummy bridges 12*d* being located in the slots 12*a*. Although the plurality of dummy bridges 12*d* are formed to have a similar appearance to the plurality of real bridges, they do not link the strips 12*b* together. Each dummy bridge 12*d* has a thin dummy slot that prevents the dummy bridge 12*d* from linking adjacent strips 12*b* together. Each one real bridge 12*c* links two adjacent strips 12*b* together.

The center of the aperture portion 12 is marked by C, as shown in FIGS. 1 and 3. As shown in FIG. 1, the line 3 represents a center line extending from the center C of the aperture portion 12 along the longitudinal direction (Y axis direction). As shown in FIG. 1, the line 3' represents a center line extending from the center C of the aperture portion 12 along the transverse direction (X axis direction).

A plurality of strips and slots of the central apertured portion 12 are not shown in FIGS. 1 and 2, in order to clarify and simplify the discussion of the present invention. A plurality of strips and slots are formed on the entire surface of the apertured portion 12, even though they are not shown in the FIGS. 1 and 2.

In the apertured portion 12 shown in the magnified circles in FIGS. 1 and 2, a transverse pitch of a real bridge is Ph, and a longitudinal pitch of a real bridge is Pv. It is desirable that they satisfy the inequality $5.0 \leqq Pv/Ph \leqq 12.0$. Otherwise, doming can take place if $Pv/Ph<5.0$, while unwanted vibration can occur if $Pv/Ph>12.0$.

In addition, supporting ends 14 are formed at the edges of the flatmask 10' for decreasing the stress on the apertured portion 12 and for convenience of handling. FIGS. 1–3 show a plurality of long supporting ends 14*a* and short supporting ends 14*b*. FIG. 4 shows a long supporting end 14*a'* and a short supporting end 14*b'*.

For good thermal expansion and uniform distribution of stress on the apertured portion 12 while being held under tension, the apertured portion 12 of the flat mask 10' is formed to be either a pin-cushion type or a barrel type as shown in FIGS. 3 and 4, respectively. The short supporting ends 14*b* and 14*b'* are curved to have the same curvature as the side edges of the apertured portion. The precise relationship between the widths w1 and w2 is not critical. However, it is desirable for the widths w1 and w2 to be similar.

The strips 12*b* in the apertured portion 12 are shaped to form a pattern that corresponds to the shape of the apertured portion 12. Thus, the strips 12*b* can form a pin-cushion pattern or a barrel pattern, depending upon the shape of the apertured portion 12.

When the apertured portion 12 is shaped in a pin-cushion shape (as shown in FIGS. 1 and 3), then the strips 12*b* are shaped to form a pin-cushion pattern. In this way, some strips 12*b* will curve inwardly to the center of the apertured portion 12 by curving to the right along the X axis, and some other strips 12*b* will curve inwardly to the center of the apertured portion 12 by curving to the left along the X axis, as shown in FIG. 1.

When the apertured portion 12 is shaped in a barrel shape (as shown in FIG. 4), then the strips 12*b* are shaped to form a barrel pattern. In this way, some strips 12*b* will curve outwardly away from the center of the apertured portion 12 by curving to the left along the X axis, and some other strips 12*b* will curve outwardly from the center of the apertured portion 12 by curving to the right along the X axis, as shown in FIG. 4.

As shown in FIG. 3, the distance w1 is the width of a short supporting end 14*b*. As shown in FIG. 3, the distance w4 is half the width of the apertured portion 12. The distance w4 is measured along the line 3' (shown in FIG. 1), that is, in the center of the apertured portion 12, in the transverse direction (X axis direction). The distance w4 is measured from the center C of the apertured portion 12 to the center point CP of the inner boundary of the short supporting end 14*b*, as shown in FIG. 3. The distance w4 can be described as the halfwidth of the apertured portion 12. The distance 2w4 is the width of the apertured portion 12.

As shown in FIG. 3, the distance w3 is measured in the transverse direction (X axis direction). The distance w3 is the distance between an end point EP1 and a line L1 that is tangent to the central point CP of the inner boundary of the short supporting end 14*b*. The central point CP shown in FIG. 3 is located on the center line 3' shown in FIG. 1. The line L1 is the tangent line. The FIG. 1 shows the first end point EP1, the central point CP, and the second end point EP2. The FIG. 3 shows the first end point EP1 and the central point CP.

As shown in FIG. 4, the distance w1 is the width of a short supporting end 14*b'*, and the distance w4 is half the width of the apertured portion 12, as measured in the center of the flat mask 10' along the direction of the X axis. As shown in FIG. 4, the distance w3 is the distance between an end point EP1' and a line L2 that is tangent to the central point CP' of the inner boundary of the short supporting end 14*b'*, as measured along the direction of the X axis. The central point CP' shown in FIG. 4 is located on a center line like the line 3' shown in FIG. 1. The line L2 is the tangent line.

With reference to FIGS. 3 and 4, the distance w1 is greater than or equal to 0.02w4, and the distance w1 is less than or equal to 0.05w4. Also, the absolute value of w3 is greater than 0 millimeters (mm) and is less than or equal to 3.0 millimeters.

In the pin-cushion type, as shown in FIGS. 1 and 3, the short supporting ends 14*b* and strips 12*b* in the apertured portion 12 are formed to be concave toward a central region of the flat mask 10'. On the contrary, in the barrel type as shown in FIG. 4, the short supporting ends 14*b'* and strips 12*b* in the apertured portion 12 are formed to be convex with respect to the central region of the flat mask 10'.

In these two types, as shown in FIGS. 3 and 4, since the flat mask 10' is shrunken to some extent based on Poisson contraction when it is subjected to intense heat for a long period of time, it is possible to avoid deformation of the flat mask 10'. Therefore, electron beams land on the phosphor screen at an accurate position, thereby preventing degradation of the color purity.

Although the flat mask 10' of the pin-cushion type is mainly explained hereinafter, the present invention is not confined to the pin-cushion type, but includes the flat mask 10' of the barrel type as well.

The trend of thermal expansion at the corner portions and end portions of a central transverse line of the tension mask 10 of the above two types (of FIGS. 3 and 4) and of a rectangular type (such as that shown in FIG. 2) have been observed. As a result of these observations, the pin-cushion type and the barrel type have been proven to be preferable over the rectangular type with respect to initial doming and electron travel with the passage of time.

As shown in FIGS. 3 and 4, the distance between an end point (EP or EP') of an inner boundary of the short supporting ends and a tangent line contacting a central point (CP or CP') is referred to as width w3. The width w3 is assumed to be a positive value, namely "+w3" in the pin-cushion type shown in FIG. 3, and it is assumed to be a negative value, namely "−w3" in the barrel type shown in FIG. 4.

According to an experiment made by the inventors, displacement of the slots at the portions near the edges of the apertured portion 12 in the transverse direction was observed to decrease as the width "+w3" or "−w3" increased from 0 mm. Accordingly, the width w3 may be greater than 0 mm.

In addition, as the width w3 increases, strips 12*b* and short supporting ends 14*b* of the flat mask 10' are liable to be contracted when the flat mask is held under tension. For example, when the width w3 is 3.0 mm, the strips 12*b* are contracted up to 0.5 mm. Since it is known that such a contraction of up to 0.5 mm does not influence electron beams passing through the slots 12*a,* the width w3 may be up to 3.0 mm.

Consequently, it is preferable that the inequality 0 mm<w3≦3.0 mm is satisfied. However, even if the width w3 satisfies the above inequality, it is not always possible to get good thermal expansion features and uniform stress distribution in the flat mask 10'. That is, for the purpose of accomplishing the above desirable effects, the inequality 0.02w4≦w1≦0.05w4 should be established between the width of the apertured portion 2w4 and the width of the short supporting end w1.

For the purpose of accomplishing the above desirable effects, the inequality 0.02w4≦w2 ≦0.05w4 should be established between the width of the apertured portion 2w4 and the width of the short supporting end w2.

Otherwise, for example, if the width of the short supporting ends w1 or w2 is less than 0.02 times the half width w4 of the apertured portion 12, the edges of the apertured portion 12 become fractured. In addition, for example, if the width of the short supporting ends w1 or w2 is over 0.05 times the halfwidth w4 of the apertured portion 12, wrinkles are formed on the portions near the side edges of the apertured portion 12 due to a difference between stress acting on the apertured portion 12 and on supporting ends 14*b*.

As shown in FIGS. 3 and 4, the flat mask 10' of the present invention is provided with a sloping side 14*c* near the corner portion of the supporting ends in order to increase the stress acting on the corner of the apertured portion 12, which is weaker than that of the center portion of the apertured portion 12.

With regard to the stress generated by applying sub-tension to the flat mask 10 before welding to attach it to the mask frame 20, stress $F_o$ is generated along the external side of the short supporting ends 14*b* while stress $F_i$ is generated along the internal side of the short supporting ends 14*b,* as indicated by arrows in FIG. 3. The stress $F_o$ is greater than the stress $F_i$, and the stress acting on the central portion of the short supporting ends 14*b* is greater than the stress at the corner portions. In fact, a stress acting on the central portion of the short supporting ends should be greater than a stress acting on the corner portions, because vibration can more readily occur at the central portion of short supporting ends. The corner portions do not vibrate as easily as the central portion of the short supporting ends.

However, if the stress acting on the central portion of the short supporting ends is much greater than the stress acting on the corner portion, the tension mask 10 is liable to deform during thermal expansion due to unbalanced stress over its surface. Accordingly, the flat mask 10' is provided with a sloping side 14*c* at the corner of the long supporting ends 14*a* in order to prevent unbalanced stress.

As shown in FIG. 3, a tilt angle θ is an angle of a sloping side 14*c* relative to the longitudinal direction (Y axis direction) of the short supporting ends (14*b* or 14*b*'), and the stress $F_d$ is generated by the tilt angle θ of the sloping side 14*c* along a diagonal line toward the corner portion of the short supporting ends (14*b* or 14*b*'). The apertured portion 12 is also influenced by the tilt angle θ since orientation of the stress $F_d$ is equal to that of the sloping side 14*c*. Therefore, the stress $F_d$ increases the stress acting on the corner of the apertured portion 12, which is relatively weaker than that of the center of the apertured portion 12.

The following Table 1 shows experimental data of the stress distribution over the flat mask 10' depending on the tilt angle θ. Detailed experimental data are as follows.

The size of the flat mask 10' is 580 mm wide by 545 mm long, the half size of the apertured portion 12 is 253.436 mm wide by 193.775 mm long, the width of both short supporting ends is 7 mm, and the width w3 is 1.0 mm. In this experiment, the tension mask 10 is held under a tension of 57.4 kilogram force per square meter (kgf/m$^2$) in the longitudinal direction (that is, the Y axis direction).

TABLE 1

| | stress distribution (kgf/m$^2$) | | | |
|---|---|---|---|---|
| | max | max position | min | min position |
| θ = 0° | 29.6 | 2/3 | 27.7 | corner |
| θ = 30° | 29.9 | end point | 28.8 | corner |
| θ = 45° | 30.1 | end point | 29.2 | corner |
| θ = 60° | 30.2 | end point | 29.2 | corner |

In the above Table 1, max positions are located on a transverse line (along direction of X axis) from the center point of the tension mask 10. It can be understood from the above experiment that the tilt angle θ is preferably within a predetermined maximum value and minimum value, namely in the range of 0°<θ<60°.

When using the tension mask 10 configured in the above way, good features of thermal expansion, uniform stress distribution and linear apertured portion resulted. It is also preferable with respect to initial doming and electron travel after a passage of a predetermined time when the flat mask 10' is held under tension in the longitudinal direction (Y axis direction).

Figure 5:
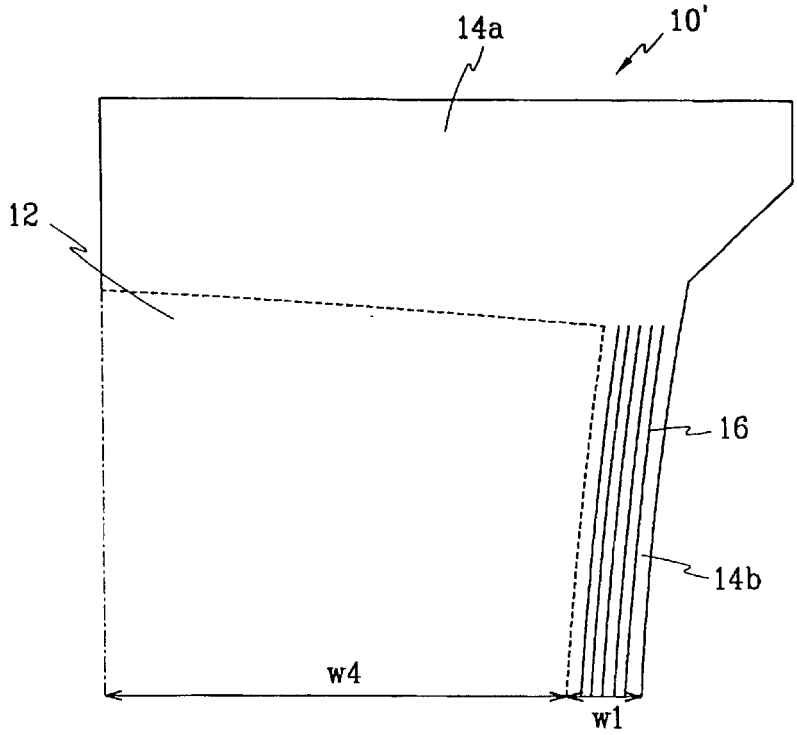
FIG. 5 is a partial plan view of the flat mask according to a second embodiment, in accordance with the principles of the present invention.
Figure 6:
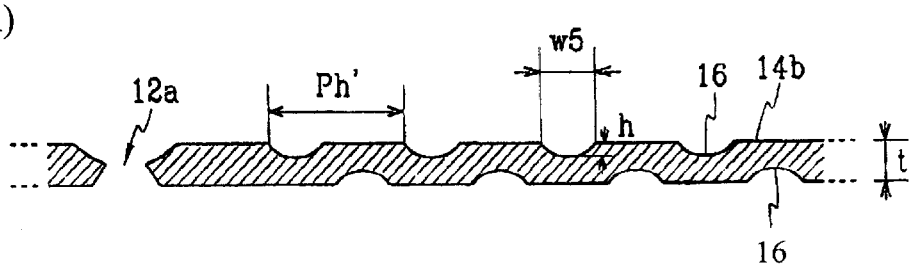
FIG. 6 is a partial sectional view of the flat mask of FIG. 5, in accordance with the principles of the present invention.
Figure 6:
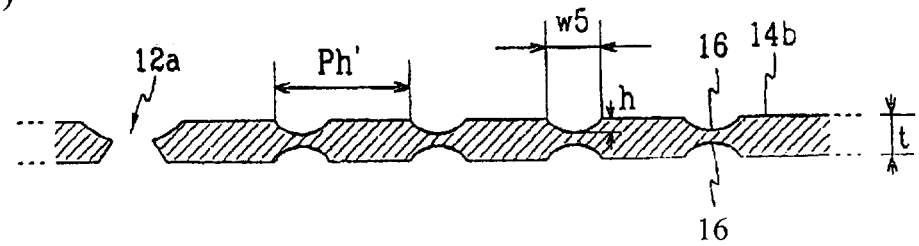

FIG. 5 is a partial plan view of the flat mask according to a second embodiment, in accordance with the principles of the present invention. FIG. 6 is a partial sectional view of the flat mask of FIG. 5, in accordance with the principles of the present invention. FIGS. 5 and 6 are a partial plan view and a partial sectional view of the flat mask 10' of which short supporting ends 14*b* are half-etched according to the second embodiment of the present invention.

As shown in FIGS. 5 and 6, removed volumes of the short supporting ends 14*b* are made to be greater than that of the apertured portion 12 by half etching the front and the rear side of the supporting ends 14*b* and then forming grooves 16. A volume of the short supporting ends 14*b* is removed when the grooves 16 are formed in the short supporting ends 14*b* of the flat mask 10'. A volume of the apertured portion 12 is removed when the slots 12*a,* strips 12*b,* real bridges 12*c,* and dummy bridges 12*d* are formed in the apertured portion 12 of the flat mask 10'.

A first volume of material is removed from the short supporting ends 14*b*. A second volume of material is removed from the apertured portion 12. According to the principles of the present invention, it is preferred that the first volume be equal to or larger than the second volume. When the short supporting ends 14*b* are etched over a large area, it is possible for the first volume to be larger than the second volume.

A difference between the removed volume of the short supporting ends 14*b* and the removed volume of the apertured portion 12 can cause a stress difference. However, even if the removed volume of the short supporting ends 14*b* is not equal to the removed volume of the apertured portion 12, when the longitudinal pitch Pv of the apertured portion 12 is less than 2.0 mm, the boundary between the apertured portion 12 and the short supporting ends 14*b* is not deformed, or is only very slightly deformed.

On the contrary, when the longitudinal pitch Pv is more than 2.0 mm, and the removed volume of the apertured portion 12 is not equal to the removed volume of the short supporting ends 14*b*, a stress difference caused by creep deformation takes place at the boundary therebetween, inducing significant deformation.

The slots formed by etching the apertured portion 12 occupy about 35±5% of the entire volume of the flat mask 10' and the remaining portion remains unetched. Therefore, there is about a 35% by volume difference between the apertured portion 12 and the supporting ends 14. If the tension is uniformly applied to all the flat mask 10', there is a discrepancy in stress caused by the volume difference in the apertured portion 12 and supporting ends 14, thereby inducing deformation at the boundary therebetween. Even though there is no deformation after attaching the flat mask to the mask frame by welding, since the structure of the mask frame is also deformed after heat treatment, the tension mask 10 is more greatly deformed as applied tension gets more intensive.

To solve these problems, it is preferable that the stress acting on the apertured portion 12 be greater than the stress acting on the supporting ends 14. This can be accomplished by making the removed volumes of the short supporting ends 14*b* larger than the removed volumes of the apertured portion 12. Therefore, it is possible to cause the stress acting outwardly on the short supporting ends 14*b* to be less than the stress acting on the apertured portion 12. As a result of this, deformation at the boundary can be lessened.

The second embodiment of the present invention will be explained with reference to FIGS. 5 and 6. According to the second embodiment of the present invention, the grooves 16 are formed on both the front and rear sides of the short supporting ends 14*b*, by half-etching in the same direction as the arrangement of slots in the apertured portion 12 of the tension mask 10 of which the longitudinal pitch Pv of the real bridge 12*c* is longer than 2.0 mm, and in particular which satisfies the inequality 2.0 mm≦Pv≦10.0 mm. The longitudinal pitch Pv of the real bridge 12*c* should not be more than 10.0 mm, because the tension mask 10 can howl if the Pv is more than 10.0 mm.

In addition, the transverse pitch Ph' of the grooves 16 can be constant or variable, and in particular it can be equal to the transverse pitch Ph of the apertured portion 12. When the width of the short supporting ends 14*b* is less than 10 mm, it is preferable that the transverse pitch Ph' of the grooves 16 be less than 10% of the width of the short supporting ends 14*b*.

In the above second embodiment, the depth h of the groove 16 can be formed within the range of 30% to 70% of the thickness t of the tension mask 10, while the width w5 of the grooves 16 can be formed within the range of 30% to 70% of the transverse pitch Ph' of the grooves 16.

Figure 7:
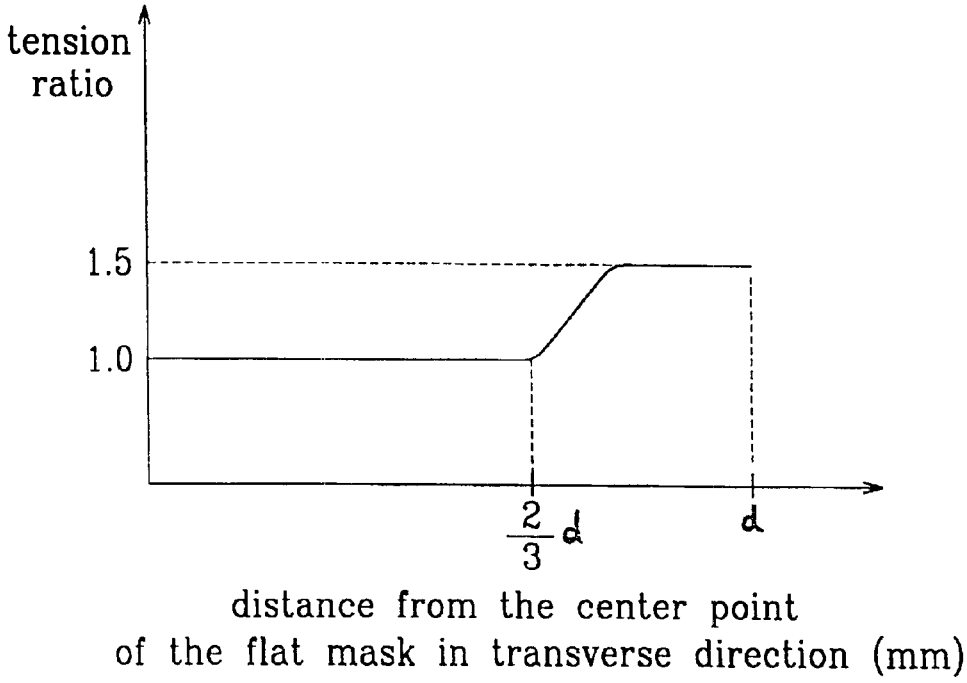
FIG. 7 shows a graph illustrating a tension ratio against distance from the center point of the flat mask in a transverse direction, in accordance with the principles of the present invention.

FIG. 7 shows a graph illustrating a tension ratio against distance from the center point of the flat mask in a transverse direction, in accordance with the principles of the present invention. The second embodiment can be realized by the following experiment. As shown in FIG. 7, the experiment is carried out under the condition of applying more tension to a portion near the side edges of the apertured portion 12 rather than to a central portion of the apertured portion 12.

According to the result of the experiment, when the ratio of removed volumes of the grooves 16 of the short supporting ends 14*b* is set at 22% by making the pitch Ph' 0.6 mm, the depth h 0.06 mm, and the width w5 0.2 mm in the mask of which thickness t is 0.13 mm and the ratio of the removed volumes of the apertured portion 12 is 35%, the tension mask 10 is observed to be significantly deformed at the longitudinal edges of the apertured portion 12 after heat treatment. However, in contrast with the above experiment, when the ratio of removed volumes of the short supporting ends 14*b* is set at 43% by making the pitch Ph' 0.6 mm, the depth h 0.08 mm, and the width w5 0.3 mm, the tension mask 10 is observed to be not deformed at the longitudinal edges of the apertured portion 12 after heat treatment, or is observed to be less deformed at the longitudinal edges of the apertured portion 12 after heat treatment.

In half-etching the supporting ends 14, the positions of the grooves 16 on the front sides of the short supporting ends 14*b* can be different from those on the rear sides as shown in FIG. 6A, or they can be opposite to each other as shown in FIG. 6B. In the latter method, as shown in FIG. 6B, it is obvious that the depth h of the grooves should be formed to be less than 50% of the thickness of the tension mask.

As is understood from the results of the experiment, the grooves 16 are formed on the front and rear sides of the short supporting ends 14*b* by half-etching in order to make the removed volume of the short supporting ends 14*b* larger than the removed volume of the apertured portion 12, thereby preventing deformation due to heat treatment.

The method of manufacturing a tension mask assembly using the flat mask 10' comprises a step of applying tension to the flat mask 10' in the longitudinal direction (along the Y axis), attaching the long supporting ends 14*a* to the supporting members 22 of the mask frame 20 by welding, and cutting off protruding portions of the long supporting ends 14*a*. The protruding portions are shown in FIG. 1 as the dotted-line end portions adjacent to the long supporting ends 14*a*. In the above step of applying tension to the flat mask 10' in the longitudinal direction, more tension is applied to the portions near the edges of the apertured portion 12 than to the central portion thereof, as shown in FIG. 7.

In summary, the present invention is accomplished by using a pin-cushion type or barrel type flat mask 10', making the short supporting ends 14*b* curved with the same curvature as the side edges of the apertured portion 12, and making the width of the short supporting ends 14*b* the same in the longitudinal direction. In addition, the present invention is accomplished by forming the width of both short supporting ends 14*b* at 0.02 to 0.05 times the half width w4 of the apertured portion 12, and making the width w3 satisfy the inequality 0 mm<w3≦3.0 mm. Therefore, side edges of the apertured portion 12 become straight when the tension is applied, and thermal expansion of the tension mask 10 in the transverse direction (along the X axis) is lessened. As a result, degradation of color purity caused by thermal expansion can be avoided.

The present invention is also carried out by providing the flat mask 10 with a sloping side near the corner portion of the supporting ends 14, and making the tilt angle θ satisfy the inequality 0°<θ<60°. Therefore, it is possible to uniformly distribute the stress generated along the short supporting ends 14*b* toward the corner of the tension mask and then increase the stress acting near the corner of the apertured portion 12.

In addition, the present invention is accomplished by providing a plurality of grooves 16 by half-etching the front and the rear sides of the short supporting ends such that the removed volumes of the supporting ends 14 can be larger than the removed volumes of the apertured portion 12. As a result of carrying out the invention, the stress applied to the areas near the side edges of the apertured portion 12 can be greater than the stress applied to the central apertured portion 12 in the transverse direction, and deformation at the boundary between the apetured portion 12 and the short supporting ends 14*b* can be prevented.

The foregoing paragraphs describe the details of a flat mask before applying tension, an assembling method thereof and a tension mask assembly manufactured by using the method, and especially a flat mask of which an apertured portion has satisfactory thermal expansion, uniform stress distribution and linearity by making the width of curved short supporting ends thereof be the same in a longitudinal direction, a method of assembling the flat mask with a mask frame, and a tension mask assembly manufactured by using the above method. The flat mask is also manufactured to prevent deformation caused by heat treatment after being held under tension.

In the drawings and specification, there have been disclosed typical preferred embodiments of the present invention, and although specific terms are employed, they are used in a generic and descriptive sense only and not for purposes of limitation, the scope of the invention being set forth in the following claims. While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A mask, comprising:

an apertured portion having curved sides and having a plurality of slots and strips, the slots being separated from each other by a predetermined interval, said apertured portion having a shape selected from among a pin-cushion shape and a barrel shape, the strips being shaped to form a pattern corresponding to the shape of said apertured portion, electron beams passing through the slots; and a plurality of supporting ends including two short supporting ends and two long supporting ends, the short supporting ends and the long supporting ends being located at respective edges of said apertured portion, the short supporting ends including a first short supporting end having an inner boundary located at one of the curved sides of said apertured portion and having an outer edge spaced apart from said apertured portion, the inner boundary being curved and extending from a first end point through a center point and to second end point, the first short supporting end having a width extending in a transverse direction from the inner boundary to the outer edge, the short supporting ends being curved to have substantially the same curvature as the curved sides of said apertured portion, said apertured portion having a width extending in the transverse direction;

the width of the first short supporting end being w1 as measured from the center point of the inner boundary to the outer edge, half the width of said apertured portion being w4 as measured from center of said apertured portion to the center point of the inner boundary of the first short supporting end, the distance between the first end point and a tangent line extending from the center point of the inner boundary being w3 as measured in the transverse direction;

the width w1 being less than or equal to 0.05w4, the width w1 being greater than or equal to 0.02w4, the absolute value of the distance w3 being greater than 0 millimeters, the absolute value of the distance w3 being less than 3.0 millimeters.

2. The mask of claim 1, the distance w3 being positive when said apertured portion has the pin-cushion shape, the distance w3 being negative when said apertured portion has the barrel shape.

3. The mask of claim 1, the width w1 of the first short supporting end as measured at the center point being substantially equal to the width of the first short supporting end as measured at the first and second end points.

4. The mask of claim 3, the distance w3 being positive when said apertured portion has the pin-cushion shape, the distance w3 being negative when said apertured portion has the barrel shape.

5. The mask of claim 4, said apertured portion having a plurality of real bridges and dummy bridges, each one of the real bridges connecting adjacent ones of the strips, the slots including the dummy bridges.

6. The mask of claim 5, further comprising a sloping side being formed adjacent to one of the short supporting ends and adjacent to one of the long supporting ends, the transverse direction being perpendicular to a longitudinal direction, the sloping side forming a tilt angle θ with the longitudinal direction, the tilt angle θ being greater than 0° and less than 60°.

7. The mask of claim 5, the transverse direction being perpendicular to a longitudinal direction, each one of the real bridges having a longitudinal pitch Pv and a transverse pitch Ph, Pv/Ph being greater than or equal to 5.0, Pv/Ph being less than or equal to 12.0.

8. The mask of claim 5, said apertured portion and said supporting ends being made of iron.

9. The mask of claim 5, the transverse direction being perpendicular to a longitudinal direction, each one of the real bridges having a longitudinal pitch Pv, Pv being greater than or equal to 2.0 millimeters, Pv being less than or equal to 10.0 millimeters.

10. The mask of claim 9, a first volume of material being removed from the short supporting ends, a second volume of material being removed from said apertured portion, the first volume being equal to or larger than the second volume.

11. The mask of claim 10, the short supporting ends each having a front side and a rear side, the front and rear sides each having a plurality of grooves formed by half-etching.

12. The mask of claim 11, the grooves being curved and being formed to extend along the curved short supporting ends substantially along the longitudinal direction.

13. The mask of claim 12, the grooves being formed to have the same curvature as the short supporting ends.

14. The mask of claim 12, each one of the grooves having a first transverse pitch, each one of the slots in said apertured portion having a transverse pitch equal to the first transverse pitch, the first transverse pitch being less than 10% of the width w1 when the width w1 is less than 10 millimeters.

15. The mask of claim 14, each one of the grooves having a depth equal to 30% to 70% of a thickness of the short supporting ends.

16. The mask of claim 14, each one of the grooves having a width equal to 30% to 70% of the first transverse pitch.

17. The mask of claim 14, the grooves on the front sides of the short supporting ends being spaced apart from the grooves on the rear sides of the short supporting ends, as measured in the transverse direction.

18. The mask of claim 14, the grooves on the front sides of the short supporting ends being not spaced apart from the grooves on the rear sides of the short supporting ends, as measured in the transverse direction.

19. A flat mask for a cathode ray tube, comprising:

a central part having curved sides and having a plurality of slots and strips, the slots being separated from each other by a predetermined interval, the strips being shaped to form a pattern corresponding to the shape of said central part, electron beams passing through the slots; and a plurality of supporting ends including two short supporting ends and two long supporting ends, the short supporting ends and the long supporting ends being located at respective edges of said central part, the short supporting ends including a first short supporting end having an inner boundary located at one of the curved sides of said central part and having an outer edge spaced apart from said central part, the inner boundary being curved and extending from a first end point through a center point and to second end point, the first short supporting end having a width extending in a transverse direction from the inner boundary to the outer edge, the short supporting ends being curved to have substantially the same curvature as the curved sides of said central part, said central part having a width extending in the transverse direction;

the width of the first short supporting end being w1 as measured from the center point of the inner boundary to the outer edge, half the width of said central part being w4 as measured from center of said central part to the center point of the inner boundary of the first short supporting end, the distance between the first end point and a tangent line extending from the center point of the inner boundary being w3 as measured in the transverse direction;

the width w1 being less than 0.05w4 and greater than 0.02w4, the absolute value of the distance w3 being greater than 0 millimeters and less than 3.0 millimeters.

20. The flat mask of claim 19, further comprising a sloping side being formed adjacent to one of the short supporting ends and adjacent to one of the long supporting ends, the transverse direction being perpendicular to a longitudinal direction, the sloping side forming a tilt angle $\theta$ with the longitudinal direction, the tilt angle $\theta$ being greater than 0° and less than 60°, said central part having a plurality of real bridges connecting adjacent ones of the strips, each one of the real bridges having a longitudinal pitch Pv and a transverse pitch Ph, Pv/Ph being greater than 5.0 and being less than 12.0, Pv being greater than 2.0 millimeters and less than 10.0 millimeters, the short supporting ends each having a front side and a rear side, the front and rear sides each having a plurality of grooves formed by half-etching.

* * * * *